United States Patent [19]

Ogawa et al.

[11] 4,445,472

[45] May 1, 1984

[54] INTERNAL COMBUSTION ENGINE WITH BEARING BEAM STRUCTURE

[75] Inventors: Naoki Ogawa, Yokohama; Toshiro Abe, Yokosuka, both of Japan

[73] Assignee: Nissan Motor Co., Ltd., Yokohama, Japan

[21] Appl. No.: 329,508

[22] Filed: Dec. 10, 1981

[30] Foreign Application Priority Data

Dec. 12, 1980 [JP] Japan ..... 55-175512

[51] Int. Cl.[3] ..... F02F 7/00; F02B 77/00

[52] U.S. Cl. ..... 123/198 E; 123/195 R; 123/195 A

[58] Field of Search ..... 123/195 R, 195 A, 195 C, 123/195 S, 198 E

[56] References Cited

U.S. PATENT DOCUMENTS

| | | | |
|---|---|---|---|
| 1,996,211 | 4/1935 | Mutchler | 123/195 S |
| 4,071,008 | 1/1978 | Skatsche et al. | 123/198 E |
| 4,213,439 | 7/1980 | Feichtinger et al. | 123/198 E |
| 4,245,595 | 1/1981 | Abe et al. | 123/198 E |
| 4,327,679 | 5/1982 | Crouch et al. | 123/195 C |
| 4,343,271 | 8/1982 | Skatsche et al. | 123/198 E |

FOREIGN PATENT DOCUMENTS

| | | | |
|---|---|---|---|
| 38560 | 10/1981 | European Pat. Off. . | |
| 53-9913 | 1/1978 | Japan | 123/195 C |
| 53-43148 | 4/1978 | Japan . | |
| 54-44117 | 4/1979 | Japan . | |
| 2074645 | 11/1981 | United Kingdom | 123/195 C |

OTHER PUBLICATIONS

"Preisgekroute Kurbelgehause—Konstruktion", H. Droscha, Automobiltechnische Zeitschrift, vol. 80, No. 5, May 1978, p. 228.

*Primary Examiner*—Ira S. Lazarus

*Attorney, Agent, or Firm*—Schwartz, Jeffery, Schwaab, Mack, Blumenthal & Koch

[57] ABSTRACT

An automotive internal combustion engine comprises a cylinder block having a plurality of cylinder bores and a plurality of bearing bulkheads, and a bearing beam structure secured to the bottom part of the cylinder block and including a plurality of main bearing cap sections each of which associates with each cylinder block bearing bulkhead to rotatably support the journal of a crankshaft, and two beam sections for securely connecting all the bearing cap sections, the two beam sections extending parallel with the axis of the crankshaft and being located at the opposite side portions, respectively, of each bearing cap section, thereby improving the strength of the main bearing cap sections and the cylinder block bearing bulkheads against the tortional and flexural vibrations to effectively suppress the vibrations of a cylinder block skirt section and an oil pan.

12 Claims, 11 Drawing Figures

INTERNAL COMBUSTION ENGINE WITH BEARING BEAM STRUCTURE

BACKGROUND OF THE INVENTION

1. Field of the Invention

This invention relates to a low-noise level automotive internal combustion engine, and more particularly to the engine equipped with a bearing beam structure for supporting a crankshaft.

2. Description of the Prior Art

As a cause of engine noise, there is vibration noise emitted from a cylinder block skirt or lower section and an oil pan which noise is caused by the vibration of a cylinder block. In order to reduce such vibration noise it seems enough to suppress vibration, due to explosion torque, applied to a crankshaft by increasing the rigidity of the cylinder block. However, this unavoidably leads to the increase in cylinder block wall thickness and accordingly to a great increase in engine weight, thereby giving rise to new problems such as reduced fuel economy. In view of this, a variety of propositions have been made to improve the rigidity of the cylinder block while suppressing the increase in cylinder block weight. Of these propositions, particular attention has been paid to the employment of a bearing beam structure which securely connects a plurality of bearing caps for directly support the crankshaft to improve the strength of bearing caps and engine parts associated with them.

BRIEF SUMMARY OF THE INVENTION

In accordance with the present invention, an internal combustion engine comprises a cylinder block having a plurality of cylinder bores and a plurality of bearing sections or bulkheads located below the cylinder bores. A bearing beam structure is secured to the bottom part of the cylinder block and includes a plurality of main bearing cap sections each of which associates with each cylinder block bearing bulkhead to rotatably support the journal of a crankshaft. The bearing cap sections are securely connected by two beam sections or members which extend parallel with the axis of the crankshaft and are located spacedly along the opposite side portions, respectively, of each bearing cap section. With this arrangement, the bearing cap sections and the cylinder block bearing bulkheads can be greatly improved in strength against torsional and flexural vibrations, thereby effectively suppressing the vibrations of a cylinder block skirt section and an oil pan.

BRIEF DESCRIPTION OF THE DRAWINGS

The features and advantages of the internal combustion engine according to the present invention will be more appreciated from the following description taken in conjunction with the accompanying drawings in which like reference numerals and characters designate like parts and elements, in which.

DETAILED DESCRIPTION OF THE INVENTION

Figure 1:
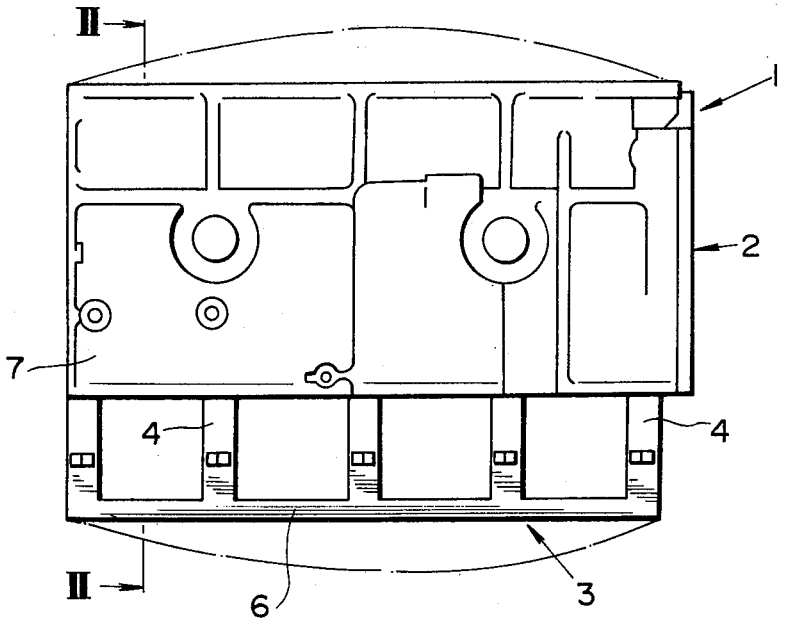
FIG.1 PRIOR ART
FIG. 1 is a front elevation of a conventional internal combustion engine.
Figure 2:
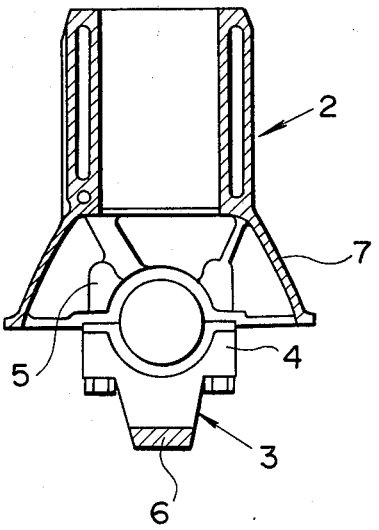
FIG.2 PRIOR ART
FIG. 2 is a vertical sectional view taken in the direction of arrows substantially along the line II—II of FIG. 1.
Figure 3:
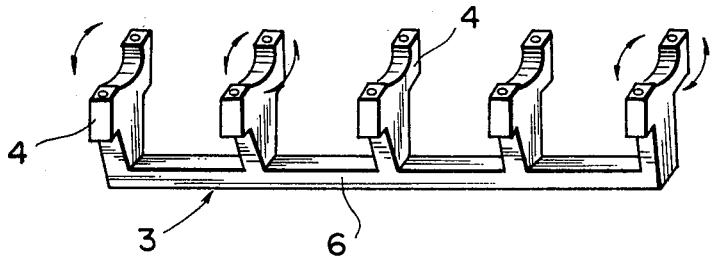
FIG.3 PRIOR ART
FIG. 3 is a perspective view of a conventional bearing beam structure used in the engine of FIG. 1.

To facilitate understanding the invention, a brief reference will be made to an engine block 1 of a conventional automotive internal combustion engine, depicted in FIGS. 1 to 3. Referring to FIGS. 1 and 2, the engine block 1 includes a cylinder block 2, and a bearing beam structure 3 secured to the bottom part of the cylinder block 2 by means of bolts. The bearing beam structure 3 has a plurality of main bearing cap sections 4 each of which associated with each of bearing sections 5 or main bearing bulkheads of the cylinder block 2, as shown in FIG. 3. The thus associated bearing cap section 4 and cylinder block bearing section 5 rotatably support the journal of a crankshaft (not shown). The bearing cap sections 4 are securely or integrally connected with each other through a beam section 6 extending along the axis of the crankshaft, so that the rigidity of the engine block 1 can be increased. Therefore, the engine block 1 is considerably improved in flexural rigidity against the flexural vibration indicated in phantom in FIG. 1 and against the vibration of the bearing cap sections 4 in the axial direction of the crankshaft or the forward-and-rearward direction which vibration so acts on each bearing cap section to cause it to come down.

However, with the above-mentioned arrangement, although the flexural rigidity of the engine block 1 is increased in the direction perpendicular to the crankshaft axis, a desired low level of engines noise cannot be attained because of mere contribution to slightly raise the resonance frequency of the cylinder block in the vicinity of 1800 Hz, the vibration due to such frequency being, in fact, not so critical for the total engine noise. In this connection, experimental data of usual automotive engines show that vibration frequencies ranging from 150 to 1500 Hz are critical for the vibration noise emited from the engine block 1.

Furthermore, even if each main bearing cap section 4 is prevented from vibrating in the forward-and-rearward direction, it is not effective for suppressing vibration of a cylinder block skirt section 7, which bulges outwardly to define thereinside the upper section of a crankcase (not identified), in the lateral direction or open-and-close movement direction. Accordingly, the above-mentioned arrangement is not so effective for preventing noise generation from the skirt section 7 and an oil pan (not shown) securely attached to the bottom edge of the skirt section 7. This has been confirmed by the applicants.

The applicants's experiments have revealed that the lateral vibration of the cylinder block skirt section 7 is induced by the movements of bearing cap sections 4 and the bearing bulkheads 5 due to their torsional vibration around the crankshaft axis and flexural vibration in the right-and-left direction as viewed in plan or in the direction indicated by arrows in FIG. 3. Such movements are combined and excite the vibration of the cylinder block skirt section 7 and the oil pan with the vibration frequencies ranging from about 800 to 1250 Hz. In order to suppress such vibrations, the above-mentioned conventional bearing beam structure 3 is not effective and therefore is low in noise reduction effect for the weight increase thereof.

Figure 4:
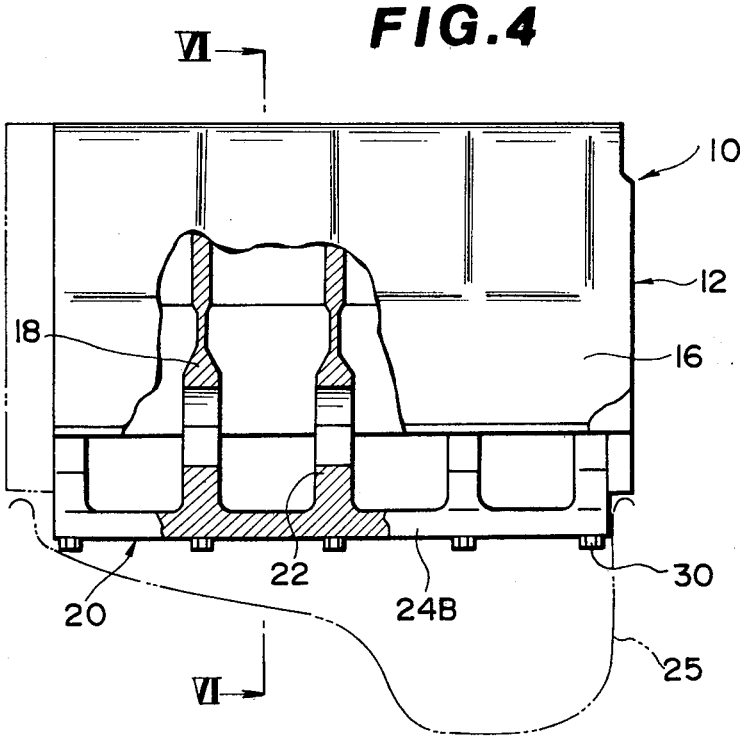
FIG. 4 is a front elevation, partly in section, of a preferred embodiment of an internal combustion engine in accordance with the present invention.
Figure 5:
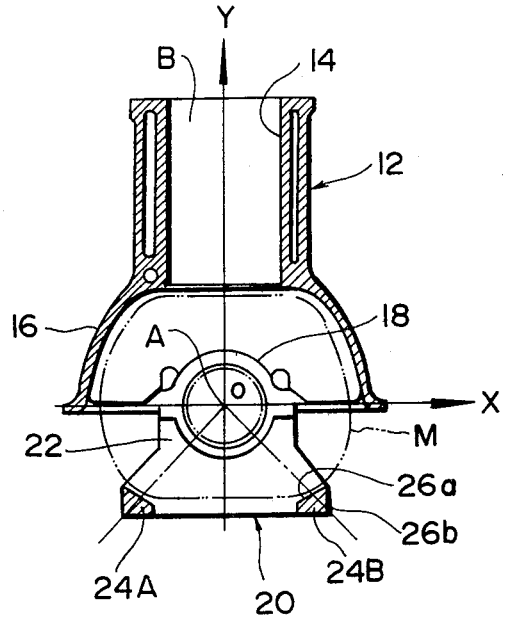
FIG. 5 is vertical sectional view taken in the direction of arrows substantially along the line VI—VI of FIG. 4.
Figure 6:
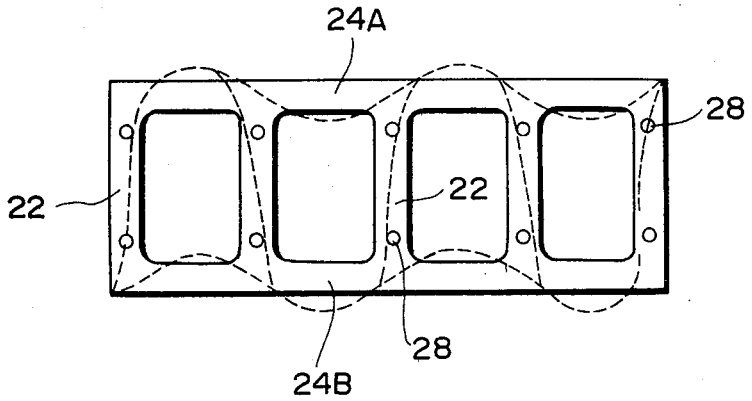
FIG. 6 is a bottom plan view of a bearing beam structure used in the engine of FIG. 4.

In view of the above description of the automotive engine provided with the conventional bearing beam structure, reference is now made to FIGS. 4 to 10, and more specifically to FIGS. 4 to 6, wherein a preferred embodiment of an internal combustion engine of the present invention is illustrated by the reference numeral 10. The engine 10 comprises a cylinder block 12 which is formed with a plurality of cylinder barrels 14 each defines therein a cylinder bore B. The cylinder block 10 is further formed at its lower part a so-called skirt section 16 which is integral with the cylinder barrels 14 and bulged outwardly or laterally to define thereinside the upper part of a crankcase (not shown). A plurality of bearing sections or main bearing bulkhead 18 are formed integral with the cylinder barrels 14 and with the skirt section 16. Each bearing bulkhead 18 is located below the cylinder barrels 14 and integrally connected to a portion between the adjacent two cylinder barrels 14.

A bearing beam structure 20 is securely connected to the bottom part of the cylinder block 12 and including a plurality of main bearing cap sections 22. Each bearing cap section 22 is rigidly attached to a cylinder block bearing section 18 so as to rotatably support the journal of a crankshaft (not shown) through a main bearing metal (not shown) carried by the combined bearing section 18 and bearing cap section 22. As shown, each bearing cap section 22 is enlarged in width at the lower or bottom part thereof to be formed generally in the shape of an issoceles trapezoid, as viewed from the direction of the axis of the crankshaft as illustrated in FIG. 5. The bearing cap sections 22 are integrally connected with each other through two elongate beam sections or members 24A, 24B which are located parallel with the crankshaft axis A. The two beam sections 24A, 24B are positioned respectively along the bottom opposite corners of the bearing cap sections 22. The beam sections 24A, 24B are located symmetrical with respect to a vertical plane which contains the crankshaft axis A and is parallel with the axes of the cylinder bores B. In other words, the two beam sections 24A, 24B are located respectively in the quadrants III and IV in a X-Y co-ordinate where X-axis intersects Y-axis (the extension of cylinder bore center axis) at right angles at the origin O, which co-ordinate is formed in a cross-section of FIG. 5 or on a vertical plane to which the crankshaft axis is perpendicular. It is preferable, on the vertical plane, that the line connecting the origin O and the center of the beam section 24A intersects the line connecting the origin O and the center of the beam section 24B at an angle ranging from 20 to 70 degrees. The the beam sections 24A, 24B are positioned outside of the envelope M of the outer-most loci of the big end of a connecting rod (not shown) as shown in FIG. 5. The beam sections 24A, 24B are suitably located to avoid the interference with the inner side and bottom surfaces of an oil pan 25 secured to the bottom edge of the cylinder block skirt section 16 in a manner to cover the bearing beam structure 20. It will be understood that the beam sections 24A, 24B serve to integrally connect all the bearing cap sections 22 so that the bearing cap sections are parallel with each other and aligned along the crankshaft axis.

Each beam section 24A, 24B is generally triangular in cross-section so as to have an inclined surface 26*a* at its side facing the crankshaft, and a ridged surface 26*b* at its side facing the oil pan 25. Additionally, it is preverable to locate the top portion of each beam section 24A, 24B over the lower-most section of the envelope M of the outer-most loci of the connecting rod big end as shown in FIG. 5, which improves the geometrical moment of inertia of the bearing beam structure 20 in the right-and-left direction or the direction around the cylinder bore center axis.

Furthermore, in this instance, the beam sections 24A, 24B are located outside of bolt holes 28 formed of the bearing cap sections 22 which holes take bolts 30 (shown in FIG. 4) for installation of the bearing beam structure 20 to the cylinder block 12, thereby facilitating installation operation of the bearing beam structure onto the cylinder block 12 in the assembly process of the engine 10.

With the thus arranged bearing beam structure 20, the bearing cap sections 22 are noticeably increased in the strength against the downward vibration applied thereto in the direction of the crankshaft axis and in the torsional strength in the direction around crankshaft axis. Additionally, the bearing cap section 22 are also increased in the flexural strength in the direction around the cylinder bore center axis. As a result, the torsional and flexural vibrations (indicated by broken lines in FIG. 6) of the bearing bulkhead 18 combined with the bearing cap section 22 are greatly suppressed, which effectively prevents the lateral vibration or open-and-close movement vibration (membrane vibration) of the skirt section 16 which is integrally connected to the bulkheads 18. Therefore, the engine noise due to vibration of the cylinder block skirt section 16 and the oil pan 32 can be noticeably decreased, thereby greatly contributing to the total engine noise reduction.

Figure 7:
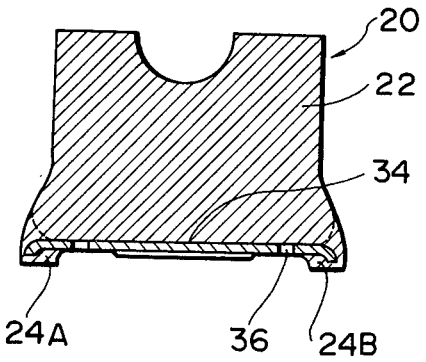
FIG. 7 is a vertical sectional view of a bearing beam structure of another embodiment of the engine according to the present invention.
Figure 8:
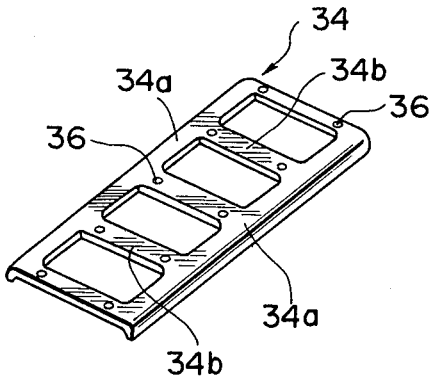
FIG. 8 is a perspective view of a reinforcement frame member used in the bearing beam structure of FIG. 7

FIGS. 7 and 8 illustrate another embodiment of the engine according to the present invention, in which a reinforcement frame member 34 is inserted or embedded in the bearing beam structure 20 during the casting of the bearing beam structure whose parent material is light alloy such as aluminum alloy, in order to increase the resonance frequency of the bearing beam structure 20 thereby to improve the dynamic rigidity thereof.

As shown in FIG. 8, the reinforcement frame member 34 is formed, for example, of pressworked steel plate and formed in the shape of a grid so as to be embedded in the bottom part of the bearing beam structure 20. In this instance, the reinforcement frame member 34 includes two parallel straight long portions 34*a*, and a plurality of parallel straight short portions 34*b* each of which connects the long portions 34*a*. The long portions 34*a* are embedded respectively in the two beam sections 24A and 24B, whereas the short portions 34*b* are embedded respectively in the bearing cap sections 22. As clearly shown in FIG. 7, the reinforcement frame member 34 is inserted in such a manner that its portions each having a bolt hole are exposed in order that such portions serve as washers when the installation bolts 30 are tightened. The thus arranged bearing beam structure 20 can effectively suppress the pitching or waving movement and the flexural vibration in the lateral or right-and-left direction of the beam and bearing cap sections 24A, 24B, 22, thereby contributing to the weight lightening of the bearing beam structure 20.

Figure 9:
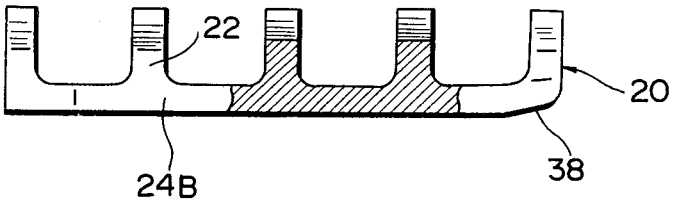
FIG. 9 is a front elevation, partly in section, of a bearing beam structure of a further embodiment of the engine according to the present invention.
Figure 10:
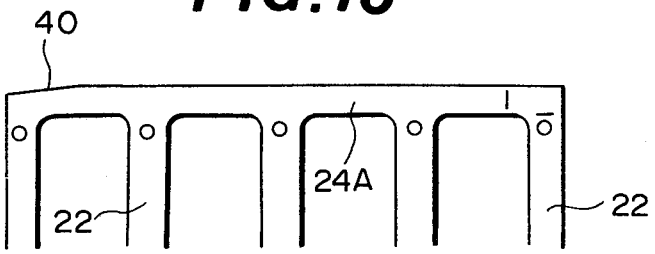
FIG. 10 is a fragmentary bottom plan view of the bearing beam structure of FIG. 9.

As shown in FIGS. 9 and 10, it is preferable to form cutout portions 38, 40 respectively at the rear end bottom part (in FIG. 9) and the front end side part (in FIG. 10) of the beam sections 24A, 24B of the bearing beam structure 20, each cutout portion defining an inclined surface. With this arrangement, the bearing beam structure 20 is prevented from interference or contact with the inner wall surface of the oil pan 32 without causing lowering in strength thereof thereby making efficient use of space to be advantageous in engine layout.

Figure 11:
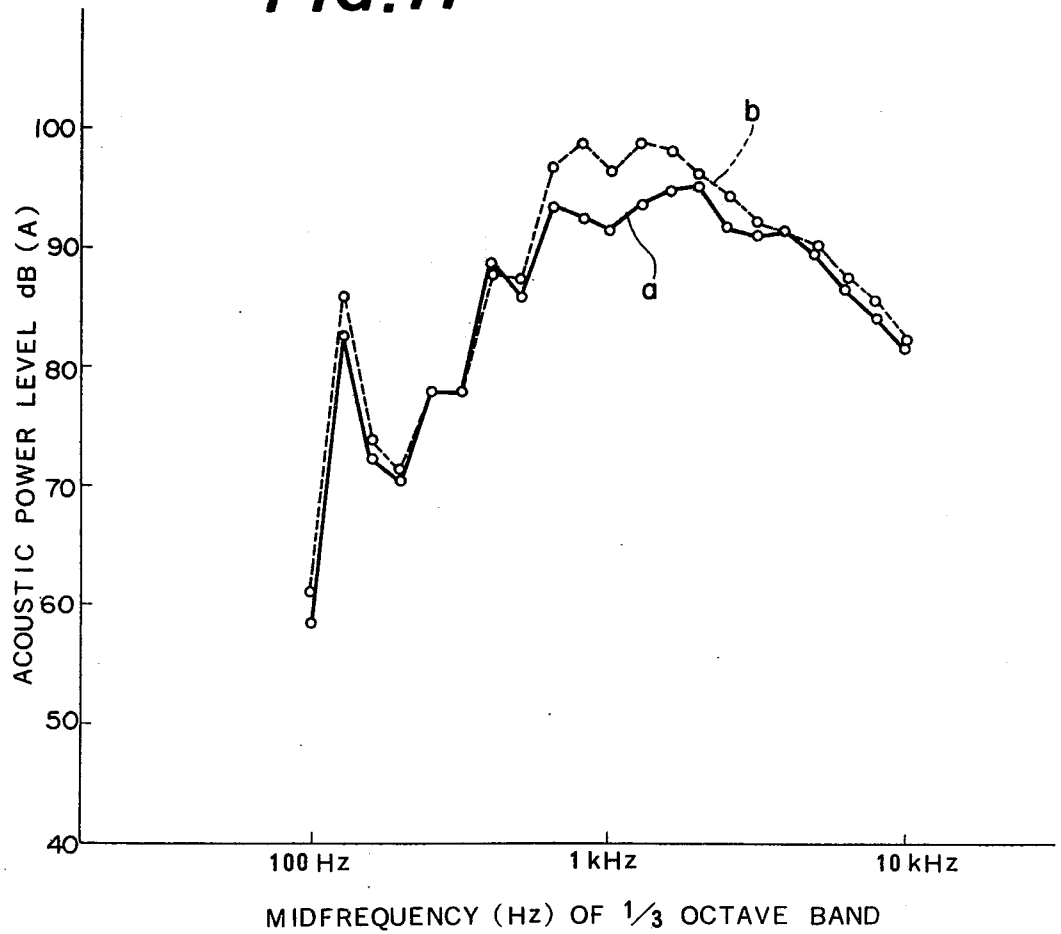
FIG. 11 is a graph of acoustic performance data of the engine according to the present invention and the conventional engine.

FIG. 11 shows acoustic performance comparison data between the engine according to the present invention shown in FIGS. 4 to 6 and the conventional engine shown in FIGS. 1 to 3, which data were obtained by the tests conducted under the test conditions where the four-cylinder type engines were operated at an engine speed of 4000 rpm, at full throttle, and at a spark timing of M.B.T (minimum advance required for the best torque). In FIG. 11, a solid line a indicates the performance data of the engine according to the present invention, and a broken line b indicates the performance data of the conventional engine. These data reveal that the engine according to the present invention is considerably low in sound emission level as compared with the conventional engine, and therefore it will be understood that the bearing beam structure of the present invention greatly contributes to lowering engine noise level.

As is appreciated from the above, according to the present invention, two beam members are disposed to connect all bearing caps at the bottom opposite sides of each bearing cap. This can effectively increase the rigidity against the torsional vibration and flexural vibration in the lateral direction applied to the bearing caps and the bearing bulkheads. As a result, the open-and-close movement vibration (membrane vibration) of the cylinder block skirt section can be reliably and effectively suppressed, thereby noticeably reducing noise of a frequency range which is the most critical in total automotive engine noise.

Besides, the bearing beam structure of the present invention can effectively improve the cylinder block in its overall torsional and flexural rigidities in the upward-and-downward and rightward-and-leftward directions, thereby greatly contributing to reduction of the vibration noise at a high frequency range.

What is claimed is:

1. An internal combustion engine comprising:

a cylinder block having a plurality or cylinder bores and a plurality of bearing sections located below said cylinder bores;

a bearing beam structure secured to the bottom part of said cylinder block and including a plurality of main bearing cap sections each of which is associated with a bearing section of said cylinder block to rotatably support the journal of a crankshaft, and first and second beam sections for securely connecting all said main bearing cap sections, said first and second beam sections extending parallel with the axis of the crankshaft and being located spacedly along the opposite side portions, respectively, of each bearing cap section.

2. An internal combustion engine as claimed in claim 1, wherein said bearing cap sections are aligned and disposed parallel with each other, each bearing cap section having a top portion, and having a bottom portion which is larger in width than its top portion which is securely connected to each bearing section of said cylinder block.

3. An internal combustion engine as claimed in claim 2, wherein said first and second beam sections of said bearing beam structure are disposed respectively along the opposite corners of the bottom portion of each bearing cap section.

4. An internal combustion engine as claimed in claim 1, wherein said first and second beam sections are so positioned that a line connecting the crankshaft axis and the center of said first beam section intersects a line connecting the crankshaft axis and the center of said second beam section at a angle ranging from 20 to 70 degrees, on a vertical plane to which the crankshaft axis is perpendicular.

5. An internal combusition engine as claimed in claim 1, wherein said first and second beam sections are so positioned as to be symmetrical with respect to a vertical plane containing the crankshaft axis and parallel with the center axes of the cylinder bores.

6. An internal combustion engine as claimed in claim 5, wherein said first and second beam sections are generally triangular in section at their portion between said adjacent two bearing cap sections, each of said first and second beam sections being so located that the inclined surface of said beam section faces the inside of said bearing beam structure, said inclined surface being inclined relative to a horizontal plane perpendicular to the vertical plane containing the crankshaft axis.

7. An internal combustion engine as claimed in claim 6, wherein the top portion of each beam section defining said inclined surface is located over the bottom part of the envelope of the outer-most loci of the big end of a connecting rod.

8. An internal combustion as claimed is claim 1, further comprising a reinforcement frame member formed of a metal plate which is higher in rigidity than the parent material of said bearing beam structure which is produced by integrally casing said bearing cap and beam sections, said frame member being embedded in the lower part of said bearing beam structure.

9. An internal combustion engine as claimed in claim 8, wherein the parent material of said bearing beam structure in light alloy, and said metal plate is a steel plate.

10. An internal combustion engine as claimed in claim 8, wherein said reinforcement frame member is generally in the shape of a grid, wherein said reinforcement frame member includes two oppositely disposed long portions and a plurality of short portions connecting said two long portions, said two long portions being embedded respectively in said first and second beam sections, and said short portions being embedded respectively in said bearing cap sections.

11. An internal combustion engine as claimed in claim 8, wherein said reinforcement frame member is formed with a plurality of bolt holes which respectively take bolts for installing said bearing beam structure to said cylinder block, said reinforcement frame member being exposed at its parts each being in the vicinity of each bolt hole.

12. An internal combustion engine as claimed in claim 8, wherein each beam section of said bearing beam structure is formed with a cutout portion to prevent the contact thereof with an oil pan which is disposed to cover said bearing beam structure.

* * * * *